United States Patent [19]

Bellis

[11] 4,136,812

[45] Jan. 30, 1979

[54] JOINING METALS

[75] Inventor: John Bellis, Wrexham, Wales

[73] Assignee: British Steel Corporation, Great Britain

[21] Appl. No.: 764,206

[22] Filed: Jan. 31, 1977

[30] Foreign Application Priority Data

Jan. 30, 1976 [GB] United Kingdom ..... 3766/76

[51] Int. Cl.[2] ..... B22F 3/00

[52] U.S. Cl. ..... 228/175; 75/208 R; 75/200; 428/557; 156/309; 156/329; 156/155; 156/157

[58] Field of Search ..... 156/309, 325; 428/557; 75/208 CS, 208 R, 200

[56] References Cited

U.S. PATENT DOCUMENTS

| | | | |
|---|---|---|---|
| 2,424,557 | 7/1947 | de Bra | 428/557 |
| 2,665,960 | 1/1954 | Causley | 428/557 |
| 3,975,165 | 8/1976 | Elbert et al. | 428/557 |

*Primary Examiner*—Brooks H. Hunt

*Attorney, Agent, or Firm*—Bacon & Thomas

[57] ABSTRACT

A method for enabling an end of metallic strip produced from powder to be threaded through for example a heating furnace, comprises securing a strip end to a leader by means of an aqueous compound whose water content selected so that it is readily absorbed by the porous strip in order to provide sufficient adhesion to enable the leader to support and guide the strip.

14 Claims, 1 Drawing Figure

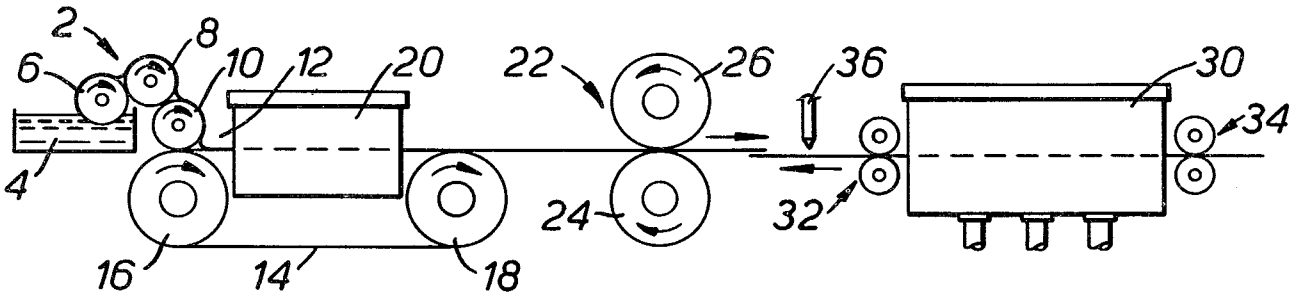
2
4
6
8
10
12
14
16
18
20
22
24
26
30
32
34
36

JOINING METALS

This invention relates to the production of metal strip from metal powder and is particularly though not exclusively concerned with the production of strip of iron or iron alloys.

In one method for producing metal strip from powder as disclosed and claimed in our United Kingdom Pat. Nos. 1,212,681 and 1,257,032, the metal particles are dispersed in a suitable fugitive binder to form a slurry which is deposited as a coherent film onto an inert support. While on the support, the film is heated, initially to gel the binder and subsequently to dewater the slurry and leave a metallic strip which ideally is flexible and self-supporting. Subsequently the strip is compacted to produce a "green" strip which is then subject to a sequence of compaction and sintering operations well known in the art to produce a final strip of the required characteristics.

In an alternative method for producing metal strip, the particles in dry form are continuously deposited from a metered source into the nip between a pair of rolls effective directly to produce the initial compaction to green strip which is then subject to the further compaction and sintering processes appropriate to this route.

While the mechanical characteristics of green strip obtained from the wet slurry process and from the dry direct compaction process do differ, they do display in common, extremely low flexibility and mechanical strength and green strip is accordingly extremely liable to disintegration when subject to mechanical strain.

Proposals have been made for overcoming the poor mechanical properties of green strip in strip from powder processes in general and at the first sintering operation in particular. These proposals include the use of a hover furnace in which the green strip is supported upon a cushion of gas rather than mechanically supported together with means for ensuring that the strip is fed through the furnace without any induced stress or strain liable to produce fracture, disintegration or degradation of properties.

The problem of threading the head of green strip inter alia through a hover or other sintering furnace employed does however remain and conventional solutions have proved unacceptable. Attempts have for example been made to apply techniques known per se for feeding conventional hot band or cold reduced strip through a furnace such as a continuous annealing furnace, by attaching the uncoiled head of the strip to the end of a strip "leader" which already has been threaded through the furnace in a previous operation. The leader is conventionally secured to the production strip by welding or by rivetting, an expedient which together with other mechanical equivalents have been found unsatisfactory for green strip particularly since induced stress in the green strip should be avoided. Another requirement is that securement must be affected with the on-line speed of the strip and the leader being substantially matched.

According to its broadest aspect, the present invention provides a method for securing metallic strip produced from metal powder to means by which a strip end may be supported for guidance along a selected path, the method consisting of interposing between overlapping regions of the support means and the strip end an aqueous compound having a water content which can be absorbed by the strip to an extent sufficient to enable the compound to provide adequate adhesion for support and/or guidance.

In the case where the porous strip is to be guided through a heating furnace, such as a hover furnace effective to produce sintering, the aqueous compound is non-fugitive so that apart from further loss of water no decomposition resulting in failure of adhesion is likely to occur.

In a preferred embodiment of the invention the non-fugitive aqueous compound is an alkali metal silicate which can quickly be applied between the head of the green strip and the adjacent tail of a suitable leader effective to guide the strip through the sintering furnace. Suitably the silicate or alternative compound is applied to the uppermost side of the leader tail so as to provide additional support for the head of the green strip.

Suitably the alkali metal silicate is sodium silicate. Aqueous sodium silicate unlike normal organic adhesives does not possess true initial tack sufficient to produce the required degree of adhesive securement between green strip and a leader. However it is believed that the progressive adhesive effect of the silicate which is displayed after contact with green strip is due to water absorbed by the strip as a result of its surprising porosity. This is believed to be the predominant mechanism, since adequate bonding can be obtained by the use of the silicate on green strip produced by the dry route. However at least one further secondary mechanism is believed to exist in the case of green strip produced by the wet or slurry route.

In the embodiments of the wet or slurry route such as are disclosed in our co-pending UK patent application No. 43852/75, methyl cellulose used as the fugitive binder material has its pH adjusted to increase the rate at which viscosity of the slurry stabilizes. The pH of green strip so produced is about 8.2 and is believed to induce precipitation from the silicate of hydrated silica gel which complements the absorption effect of the porous green strip. An increase in the rate at which the silicate develops adhesive properties may accordingly be produced by adjusting the pH of the green strip to induce precipitation. The onset of adhesive action may be further improved by promoting a gelling action of the silicate for example by the introduction of an additive such as a polyhydric alcohol.

Suitably the non-fugitive compound contains a filler or other aqueous adhesive effective to impart some degree of flexibility to the bond between the green strip and the leader when heated on passing through the sinter furnace. In either the dry or in the slurry route, the green strip is sintered at a temperature of about 1150° C. Sodium silicate for example suffers a trasition to a glass at this temperature and becomes brittle to the point where a risk of failure of the bond is likely to occur. A suitable filler such as an inorganic clay silicate used in concentrations of up to 50% by weight can reduce the brittleness sufficient to reduce the risk of such failure.

In an alternative embodiment the action of the adhesive may be supplemented by interposing a suitable brazing compound between the potentially contiguous regions of the green strip and the leader. Conveniently the brazing compound is applied in particulate form preferably pre-mixed with a flux and may be constituted of a copper/nickel or copper/iron alloy or suitable alloys of silver which can melt and form an effective joint at the sintering temperatures used.

An embodiment of the invention will now be particularly described by way of example with reference to the accompanying drawing which schematically illustrates a number of stations in apparatus for producing iron strip from powder.

Referring to the drawing, the apparatus comprises a station indicated generally at 2 at which a slurry 4 of iron powder and methyl cellulose binder is retained in a suitable vessel for deposition onto an inert substrate. The slurry may be that disclosed in our co-pending UK patent application No. 43852/75 and conveniently constitutes multiples of 300g of methyl cellulose treated with glyoxal as a solubility inhibitor together with 12 liters of water containing specific slurry and wetting agents.

At station 2 the slurry 4 is transferred by way of train of rollers 6 and 8 onto a coating roller 10 arranged uniformly to deposit slurry to a selected thickness and width onto the region 12 of a continuous belt 14 of inert metal such as stainless steel looped around drums 16 and 18. Drive applied to at least one of the drums feeds the belt through a drying furnace 20 effective initially to gel and subsequently to drive off water from the slurry; this emerges from the furnace as a flexible and self-supporting strip which can be continuously peeled off from the pretreated and polished surface of belt 14.

At station 22, the metallic strip is applied to the nip between a pair of rolls 24, 26 effective to produce the first stage of compaction to green strip which emerges downstream of the nip at on-line velocity. To thread the green strip through the sintering furnace 30, indicated as a hover furnace, a leader of conventionally cold reduced strip is initially threaded so as to extend to a point adjacent the rolls 24, 26. A gun 36 ideally supported to lay down discrete longitudinal strips of adhesive is arranged to dispense a metered quantity of aqueous sodium silicate onto that region of the upper face of the leader which will underlie the head of the green strip emerging from rolls 24 and 26. The silicate is selected to match the porosity of the green strip and ensure that an adequate degree of adhesion is obtained as quickly as possible.

At the point of overlap the leader has been accelerated by the pair of drive rolls 32 and 34 respectively disposed at opposite ends of the furnace 30, so as to produce velocity matching and avoid induced strains in the green strip when adhesively secured to the leader by way of the silicate.

After initial contact rolls 32 bring the tail of the leader into intimate contact with the head of the green strip and increase both the area over which the bond is produced as well as the area over which water is absorbed from the sodium silicate dispensed by the gun 36.

While it is difficult to define the porosity of any particular sample of green strip obtained from a specific slurry composition, and therefore the water content of the silicate, it has been found that sodium silicate containing 62% by weight of water can provide sufficient adhesion within the time period permitted by green strip progressing at an on-line velocity of about 30m per minute.

Within the sinter furnace 30 the silicate rapidly loses further water and forms a glass effective to maintain the bond between the strip and the leader. The relatively small thickness of the silicate glass layer produced by compression at rolls 32 is sufficient in most cases to prevent failure when the bond passes through the nip between the drive rolls 34. Any onset of failure can however be reduced by the additional use of a filler or by the use of brazing techniques hereinbefore described.

It will be appreciated that while the invention has been described with reference to sodium silicate any alkali metal, silicate or indeed any aqueous non-fugitive compound capable of providing adhesive properties on water loss may be used. It will also be appreciated that while the invention has been described with reference to a hover furnace sintering may equally be produced with a furnace of conventional type without departing from the scope of this invention.

The use of the invention avoids the need to mechanically secure green strip to a leader moving at the same velocity and consequently reduces the strains inherent in the mechanical methods previously proposed. While a leader of cold reduced strip has been described, any suitably rigid member may be utilised to support the metallic strip for guidance.

It will also be appreciated that while the invention has been generally described with reference to the use of a gun to dispense metered quantities of silicate for adhesive purposes, various modes of applying adhesive may be employed. For example an airless spraying technique has been found particularly useful in overcoming difficulties arising from the application of adhesive and is especially useful in relatively large plant.

I claim:

1. A method for securing green metallic strip produced from metal powder to means by which a strip end may be guided along a selected path, the method consisting of interposing between overlapping regions the means and the strip end an aqueous composition having a water content which can be absorbed by the strip to an extent sufficient to enable the composition to provide adequate adhesion for support and/or guidance.

2. A method as claimed in claim 1 wherein the metallic strip is supported for guidance through a sintering furnace and the aqueous composition is non-fugitive at the temperatures produced in the furnace.

3. A method as claimed in claim 2 wherein the aqueous composition incorporates a material effective to impart flexibility to the bond between the strip and the support means.

4. A method as claimed in claim 1 wherein the aqueous composition is an alkali metal silicate.

5. A method as claimed in claim 4 wherein the silicate incorporates an additive effective to promote gelling.

6. A method as claimed in claim 4 wherein the alkali metal silicate is sodium silicate.

7. A method as claimed in claim 5 wherein the silicate incorporates polyhydric alcohol.

8. A method as claimed in claim 4 wherein the silicate incorporates an inorganic clay silicate.

9. A method as claimed in claim 8 wherein the inorganic clay silicate is incorporated in concentrations of up to 50 percent by weight of the aqueous composition.

10. A method as claimed in claim 4 where the pH of the silicate is adjusted to promote gelling.

11. A method as claimed in claim 1 wherein the aqueous composition is dispensed onto the upwardly facing surface of the quide means.

12. A method as claimed in claim 1 wherein a brazing compound is interposed between contiguous surfaces of the metallic strip and the guide means so as to form an additional bond during heating.

13. A method as claimed in claim 1 wherein the strip and the guide means move with substantially matched velocities during bonding by the aqueous composition.

14. A method as claimed in claim 1 wherein the metallic strip is of iron or an iron alloy.

* * * * *